United States Patent [19]

Ripka et al.

[11] 3,998,040

[45] Dec. 21, 1976

[54] METHOD OF AND APPARATUS FOR SPINNING YARNS FROM STAPLE FIBERS BY AN OPEN-END SPINNING TECHNIQUE

[75] Inventors: Josef Ripka; Vladimir Ohlidal, both of Usti nad Orlici; Václav Vobornik, Letohrad; Jan Junek, Usti nad Orlici; František Hortlik, Usti nad Orlici; František Jaroš, Usti nad Orlici; Karel Mareš, Usti nad Orlici; Pavel Celerin, Usti nad Orlici; Zdeněk Kotrba, Usti nad Orlici; Marie Brozková, Usti nad Orlici; Ludmila Lihtarová, Usti nad Orlici, all of Czechoslovakia

[73] Assignee: Vyzkumny ustav bavlnarsky, Usti nad Orlici, Czechoslovakia

[22] Filed: Mar. 31, 1975

[21] Appl. No.: 563,294

[30] Foreign Application Priority Data

| | | |
|---|---|---|
| Apr. 3, 1974 | Czechoslovakia | 2382/74 |
| Apr. 3, 1974 | Czechoslovakia | 2383/74 |
| Apr. 3, 1974 | Czechoslovakia | 2385/74 |

[52] U.S. Cl. ..... 57/58.95; 57/156

[51] Int. Cl.[2] ..... D01H 1/12

[58] Field of Search ..... 57/50, 58.89–58.95, 57/156, 90

[56] References Cited

UNITED STATES PATENTS

| | | | |
|---|---|---|---|
| 3,355,869 | 12/1967 | Vorisek | 57/58.95 |
| 3,360,918 | 1/1968 | Doudlebsky et al. | 57/58.95 |
| 3,439,488 | 4/1969 | Bucil et al. | 57/58.95 |
| 3,523,300 | 8/1970 | Tabata et al. | 57/58.91 |
| 3,535,868 | 10/1970 | Schiltknecht | 57/58.95 |
| 3,538,698 | 11/1970 | Ripka et al. | 57/58.95 |
| 3,591,952 | 7/1971 | Ripka et al. | 57/58.95 |
| 3,605,395 | 9/1971 | Morikawa et al. | 57/58.89 |
| 3,834,148 | 9/1974 | Sakurai et al. | 57/58.95 |
| 3,864,902 | 2/1975 | Wehling et al. | 57/58.95 |

*Primary Examiner*—John Petrakes

[57] ABSTRACT

A plurality of separate fiber slivers are introduced into spaced portions of a fiber-separating zone disposed in a combing cylinder-type fiber separating apparatus. The separated fibers are separately discharged into a common duct via a fiber-stripping zone associated with each combing cylinder. The regions of introduction of the separate slivers to the combing cylinder are suitably spaced so that the resulting separated fibers discharged into the duct form a common flow in the portion of the duct between the fiber-stripping zone and the downstream end of the duct. A yarn-spinning apparatus is disposed at the downstream end of the duct for receiving the common flow of the fibers, and such apparatus is mounted for rotation about an axis which is skewed with respect to the axis of the combing cylinder.

15 Claims, 10 Drawing Figures

METHOD OF AND APPARATUS FOR SPINNING YARNS FROM STAPLE FIBERS BY AN OPEN-END SPINNING TECHNIQUE

BACKGROUND OF THE INVENTION

In the art of open-end yarn spinning, fiber slivers are introduced into a separating zone established by a combing body having needle or saw-tooth-like projections thereon. The fibers are separated by the action of the combing body, and the separated fibers are discharged into at least one duct which is in communication with the combing body to form a fiber-stripping zone. The discharged separated fibers thereupon flow through the ducts to a spinning chamber disposed at the downstream end of the duct to be spun into yarn.

In order to increase the output and/or to spin yarns formed from different types of staple fibers, one known opened spinning arrangement of this general type employs a single yarn-spinning chamber which is adapted to cooperate with a plurality of combing cylinders that receive fibers from several incident slivers. Each of the combing cylinders communicates with the interior of the yarn-spinning chamber via a separate duct; accordingly, such arrangement is expensive and complicated.

In another known multiple-feed arrangement of this general type, a single conical, rather than cylindrical, combing body is associated with a feed roller arrangement which simultaneously supplies to the body two fiber slivers of different types. In this case, the axis of rotation of the yarn-spinning chamber is coaxial with that of the conical combing body. The reliability of this arrangement is decreased because of the inevitable variations in the peripheral speeds at which the slivers are separated by the conical surface of the combing body, as well as because of the complicated configuration of the duct that propels the separated fibers toward the yarn-spinning chamber. Such decrease in reliability is especially marked at high operating speeds.

SUMMARY OF THE INVENTION

These disadvantages are overcome by the method and apparatus of the present invention. In an illustrative embodiment, the separate fiber slivers to be separated are introduced into spatially separate portions of a fiber-separating zone associated with at least one combing cylinder which is rotatable about a first axis. The application points of the separate fiber slivers are so chosen that the separated fibers are discharged from the fiber-stripping zone of the system to a common duct which extends between the fiber-stripping zone and the downstream end of the duct where the yarn-stripping chamber is disposed. Additionally, the axis of rotation of the yarn-spinning chamber is disposed in skewed relation to the first axis. In one arrangement, two separate spaced bores are provided in the housing, and separate combing cylinders are disposed in each of the bores for rotation about an axis parallel to the first axis. In this case, a first one of the fiber slivers to be separated is applied to the separating zone associated with the first combing cylinder, and the other of the fiber slivers is applied to the separating zone associated with the other combing cylinder.

Alternatively, a single bore may be provided in the housing with an associated combing cylinder, in which case the separate slivers to be introduced are applied at circumferentially or axially spaced portions of the combing cylinder.

The applying means for the fiber slivers may include separate drive rollers for each of the slivers, or may constitute a common drive roller. A fiber condenser having fiber-shaping portions are introduced in the path of the raw slivers prior to their introduction into the nip between the drive rollers and a cooperating pressure element, illustratively another roller or a shoe. The drive rollers are advantageously fluted by means of circumferentially spaced axial corrugations, with the corrugations in adjacent rollers being circumferentially offset to avoid unwanted periodicities in the resulting yarn.

BRIEF DESCRIPTION OF THE DRAWING

The invention is further set forth in the following detailed description taken in conjunction with the appended drawing, in which.

DETAILED DESCRIPTION

Figure 1:
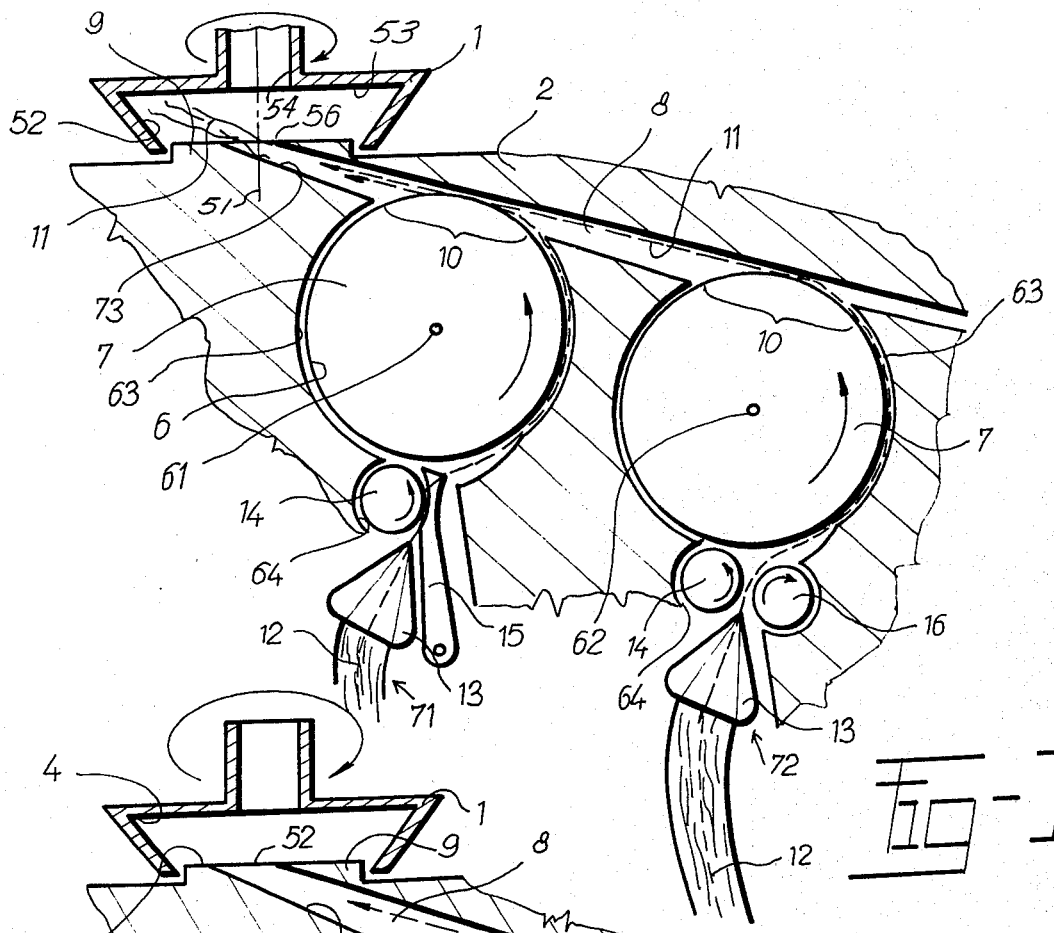
FIG. 1 is a vertical section of a first embodiment of open-end spinning apparatus in accordance with the invention, wherein a pair of axially spaced combing cylinders rotatable about axes parallel to a first axis are provided.

Referring now to the drawing, FIG. 1 illustrates a first embodiment of an apparatus in accordance with the invention for separating and stripping a plurality of fiber slivers 12—12 for application to a yarn-spinning chamber 1 or other suitable twist-forming device. The chamber 1 is externally rotatable about a shaft 51 to spin fibers introduced therein into yarn in a conventional manner. The chamber 1 includes a sloping side wall 52 for efficiently receiving the fibers and for positioning such fibers on a collecting surface 53. The yarn spun by the chamber 1 exits via a yarn exit port 54.

The separating and stripping portion of the illustrated arrangement includes a main housing 2 which, in the embodiment shown, includes a pair of spaced internal bores 6—6 in suitable communication with the exterior of the housing to receive suitable fiber sliver introduction facilities, as described below. The housing 2 further includes a common air duct 8 which is defined by an elongated internal passage extending through the housing in a downstream direction (defined by an arrow 11) to terminate in a first end 56, the end 56 being illustratively contained in a lid 9 which extends somewhat into the interior of the yarn-spinning chamber 1. The duct 8 is respectively intersected by the bores 6—6 in axially spaced portions thereof to define an arcuate fiber-stripping zone 10—10. Air or other suitable carrier gas from a source (not illustrated) may be propelled in the downstream direction through the duct 8 to accelerate separated fibers entering the duct through the stripping zone 10—10 as indicated below.

A pair of combing cylinders 7—7 are respectively disposed within the internal bores 6—6 of the housing. The cylinders 7—7 are individually rotatable about axes 61, 62 which lie in skewed relation to the axis 51 of the yarn-spinning chamber 1. An arcuate space disposed between each of the cylinders 7 and the internal wall of the surrounding bore 6 defines a fiber-separating zone 63—63 which communicates with respective fiber introduction openings 64—64 in the housing 2.

The periphery of the cylinders 7 each includes a needle or sawtooth region (not shown) which, when rotating past the introduction regions 64 of the associated bore, engages incoming fibers and conveys them around the arcuate fiber separating zone 63 to be discharged through the associated separating zone 10 into the common duct 8. (During such passage around the zone 63, the fibers may be subjected to an air flow directed circumferentially around the associated cylinder by suitable means not shown to aid in the separation of the fibers.)

A pair of fiber sliver introduction elements 71 and 72 are respectively disposed in the fiber introduction openings 64 of the respective spaced bores 6 in the housing 2 for introducing the separate slivers 12—12 into the apparatus to be separated, stripped, and spun into yarn. The device 71 includes a fiber condenser 13 for shaping and compacting the incoming sliver 12 and for introducing it into a nip formed from cooperating surfaces of a drive roller 14 and a spring-loaded pressure means, illustratively a pivotal shoe 15, which is resiliently urged against such roller 14. The roller 14 is suitably driven, by means not shown, about an axis parallel to the axis 61 of the associated cylinder for advancing the shaped and compacted sliver 12 into the arcuate fiber separating zone 63 to be separated.

The device 72 for introducing the other sliver 12 into the arcuate work space of the second bore 6 may be similar to the device 71, except that the pressure means bearing against the associated drive roll 14 may take the form of a pressure roller 16 rather than a shoe.

In accordance with the invention, the separate strands 12—12 are introduced at separate portions of the arcuate fiber separating zone 63, so that after exiting through the associated portion of the stripping zone 10, they may be joined in a common flow in a portion 73 of the duct 8 lying between the fiber-stripping zone 10 and the downstream end 56 of the duct 8.

It has been found that with this arrangement, with the fiber flows from the separate portions of the stripping zone 10 united before entry into the yarn-spinning chamber 1, various irregularities contained in the original separate fiber flows are partly compensated so that the final fiber flow supplied to the chamber 1 is in a more uniform condition. This results in an increase in the quality of the spun yarn. Additionally, it has been found that the provision of such common fiber flow in the common duct 8 allows the output of the stripping zone 10 to be increased to a degree which is more nearly coincident with the capacity of the yarn-spinning chamber 1 itself. Also advantageous is the possibility of feeding the input of the spinning chamber 1 itself with united fibers of different characteristics, such as a blend of cotton and viscose, without the necessity of employing plural ducts.

Figure 2:
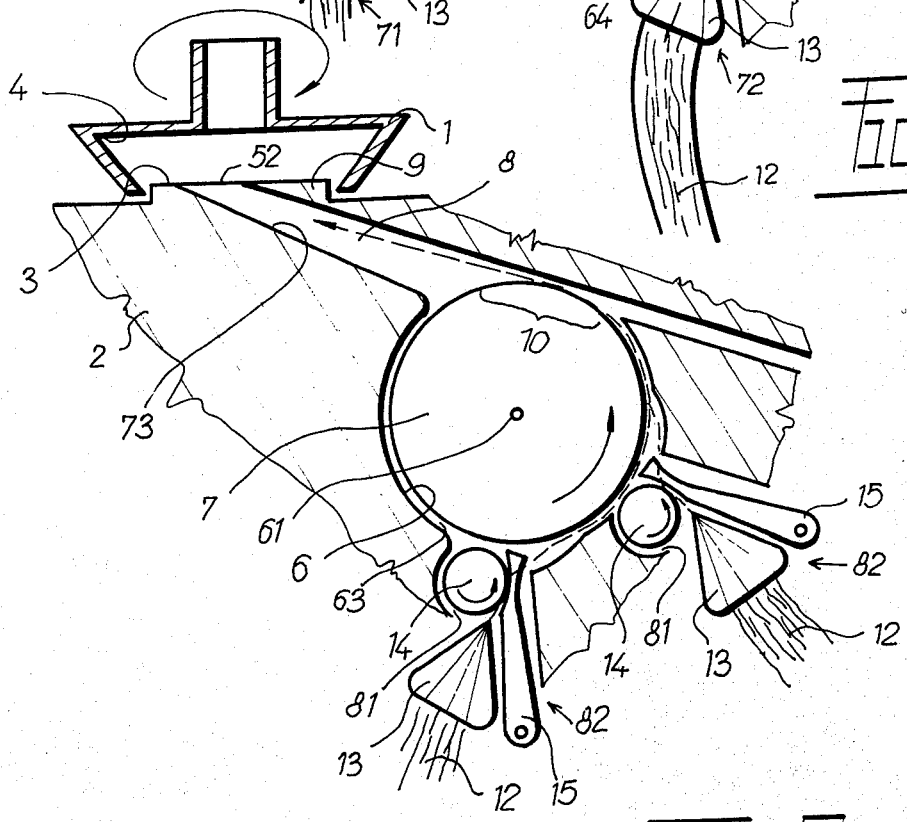
FIG. 2 is a vertical section of a second embodiment of the invention, employing a single combing cylinder having applied thereto separate fiber slivers at circumferentially spaced positions.

FIG. 2 illustrates an alternative embodiment of the invention. In this arrangement, a single internal bore 6 is provided in the housing 2, and a single combing cylinder 7 is disposed within the bore 6 to define the arcuate fiber separating zone 63. Circumferentially spaced introduction zones 81—81 are disposed in the housing 2 in communication with the bores 6 for housing identical sliver-introduction elements 82—82. The spaced introduction elements 82 and 82 are provided with a pair of drive rollers 14 which are individually rotatable on axes parallel to axis 61 of the cylinder 7. Because of the circumferentially spaced orientation of the feed lines for the slivers 12, such slivers are introduced into the zone 63 in spaced relation, where they are conveyed around the zone 63 and discharged successively via the stripping zone 10 into the downstream portion 73 of the duct 8. As in FIG. 1, the separate discharged fibers from the circumferentially spaced inlet ports of the zone 63 are joined in a common flow for introduction to the yarn-spinning chamber 1.

Figure 3:
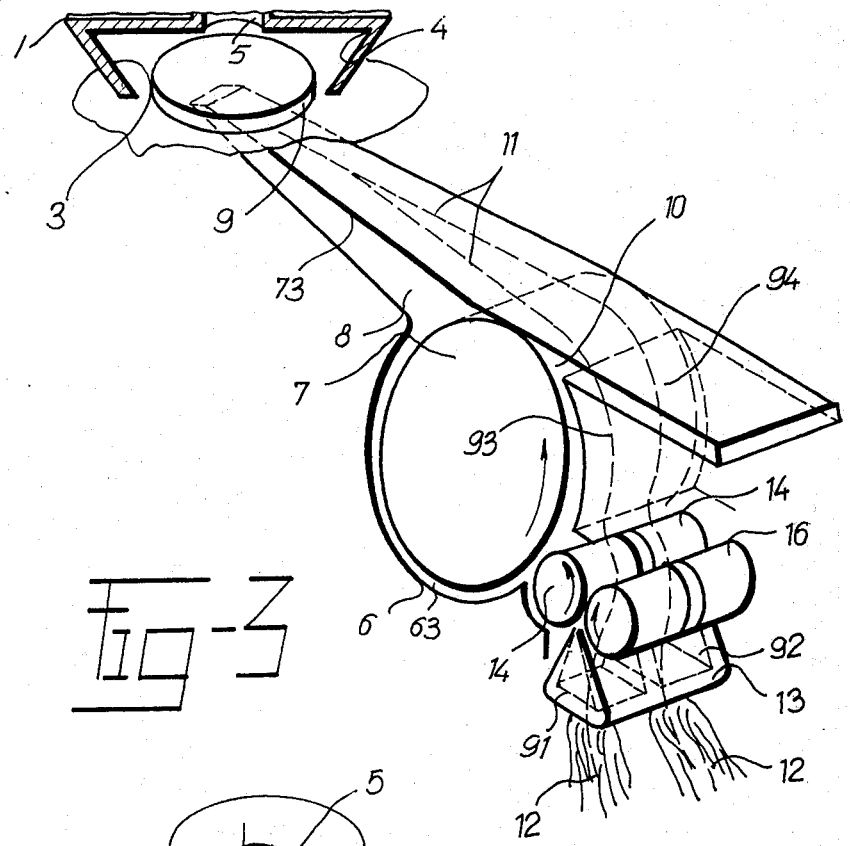
FIG. 3 is a perspective fragmentary view of a third embodiment of the apparatus in accordance with the invention, in which the separate fiber slivers are introduced at axially spaced portions of a single combing cylinder.

In the arrangement of FIG. 3, the identical drive rollers 14, rather than being circumferentially spaced around the fiber separating zone 63 of a single cylinder 7 as in FIG. 2, are axially spaced as shown. In the arrangement of FIG. 3, the fiber condenser 13 has two spaced fiber-shaping zones 91 and 92 which are preferably interchangeable to accommodate different sizes and grades of slivers 12. The slivers shaped in the condenser 13 are advanced into axially spaced portions 93 and 94 of the periphery of the cylinder 7 by being routed through the nips established between appropriate pairs of the drive rollers 14—14 and associated spring-loaded ones of pressure rollers 16—16, which take the place of the spring-loaded shoes 15—15 of FIGS. 1 and 2.

In the front portion 73 of the duct 8, the axially spaced separated fibers (11—11) are joined in a common flow for introduction into the yarn-spinning chamber 1.

Figure 4:
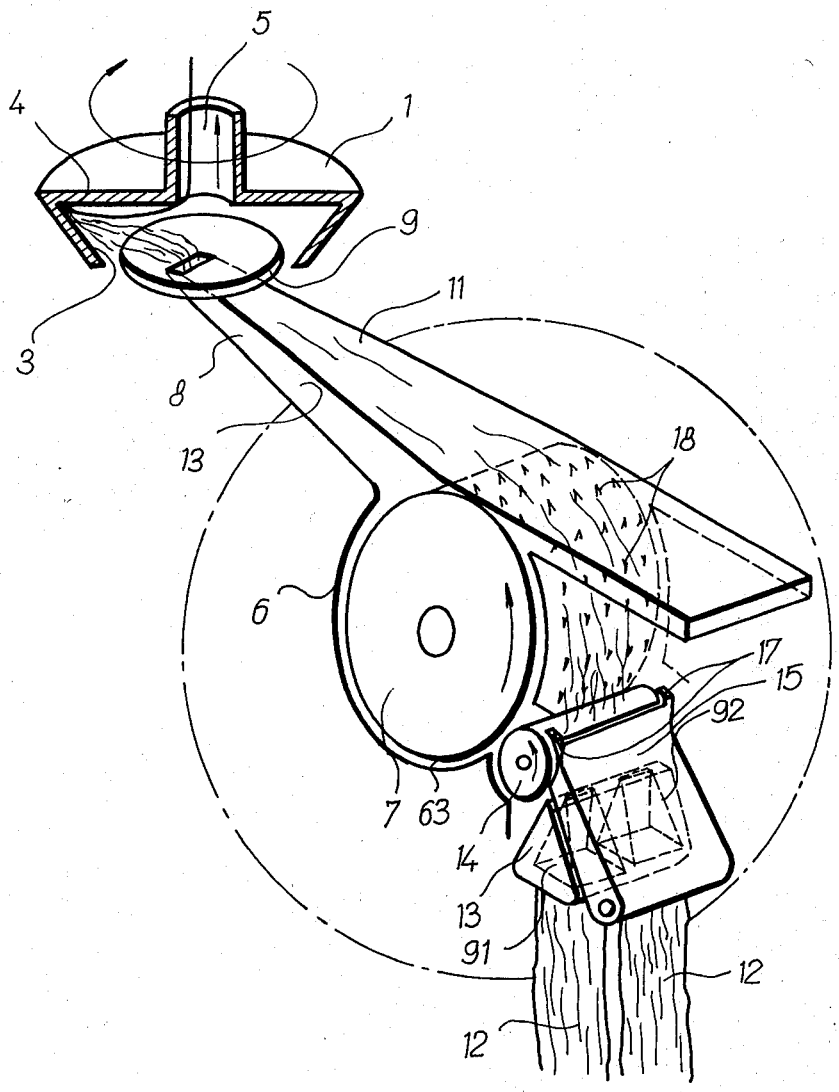
FIG. 4 is a perspective fragmentary view of an arrangement similar to that of FIG. 3, but employing a common drive roller for introducing the slivers to the combing cylinder.

In the arrangement of FIG. 4, a common drive roller 14 is provided for both of the incoming fiber slivers 12—12. In this case, the pressure element is a common spring-loaded shoe 15 that extends axially over the width of the common drive roller 14. The separate incoming slivers 12—12 are applied via the separate inserts 91, 92 of the condenser 13 to the nip between the common drive roller 14 and the associated shoe 15, to be advanced into the arcuate zone 63 of the single combing cylinder 7 shown. In all other respects the arrangement of FIG. 4 is similar to that of FIG. 3.

Figure 5:
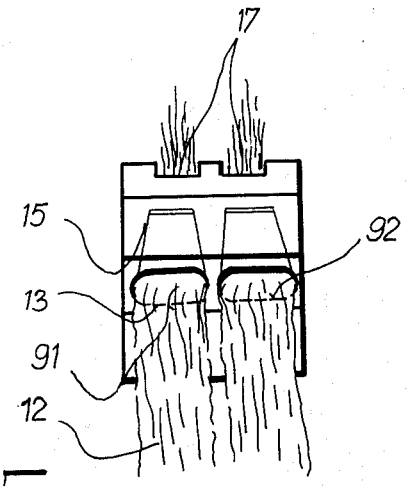
FIG. 5 is a pictorial view of a fiber condenser suitable for use in the arrangements of FIGS. 3 and 4.

FIG. 5 illustrates a more detailed view of the fiber condenser 13, and the cooperation of its fiber-shaping elements 91, 92 with the spring-loaded shoe 15. In particular, the shoe 15 is provided with cutout areas 17—17 equal in number to, and aligned with, the separate fiber-shaping portions 91 and 92 of the condenser 13. As indicated previously, such shaping portions, which may be interchangeable with similar inserts to accommodate different grades and types of fabric, are individually associated with the separate fiber slivers 12—12. The arrangement of FIG. 5 may be substituted for the sliver-feeding arrangement of FIG. 4.

Figure 6:
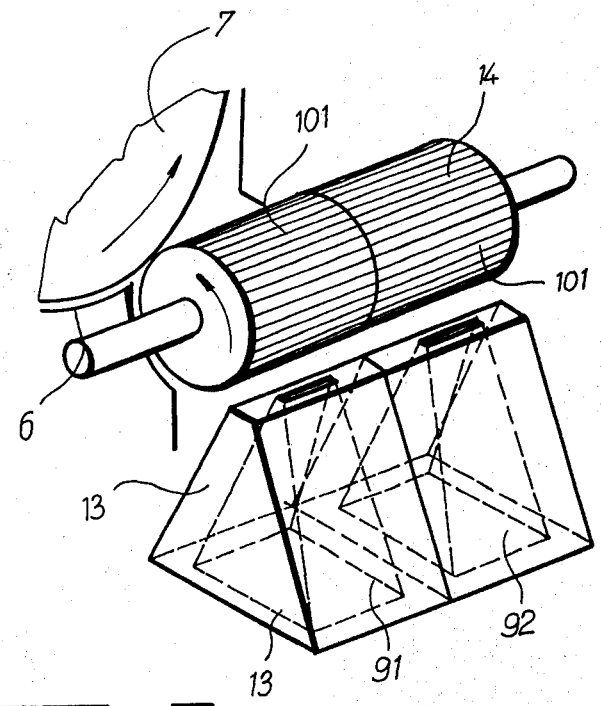
FIG. 6 is a perspective view of a fiber sliver introduction means suitable for use with the arrangement of FIGS. 3 and 4, employing a pair of axially spaced drive rollers having a fluted configuration in the form of circumferentially spaced axial corrugations.

In FIG. 6, the sliver-feeding arrangement includes a pair of axially aligned drive rollers 14—14. Each of the drive rollers is fluted with a plurality of circumferentially spaced, axially extending corrugations 101—101. The corrugations 101 of the separate rollers 14 are preferably circumferentially offset as shown, thereby avoiding unwanted periodicities in the above-mentioned common joint flow of the separated fibers derived from the distinct slivers introduced into the interchangeable shaping sections 91 and 92 of the condenser 13. If desired, the separate, axially adjacent drive rollers 14 of FIG. 6 may be replaced by a common drive roller having axially adjacent portions with offset fluting.

Figure 7:
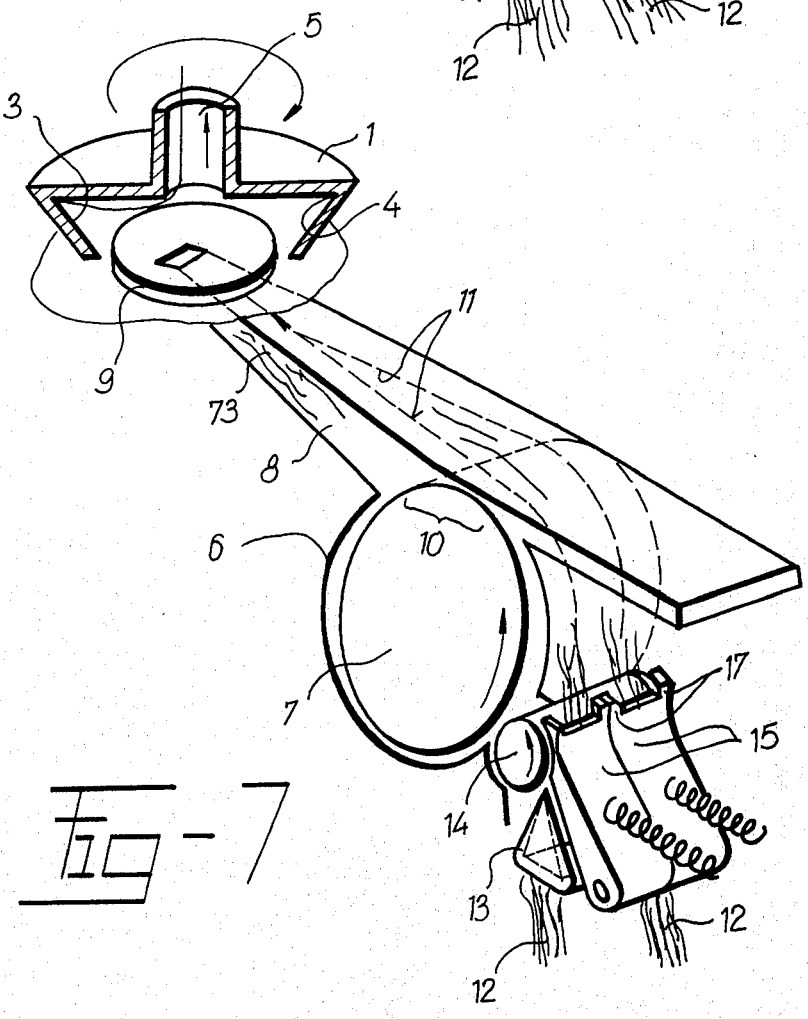
FIG. 7 is a perspective fragmentary view of an arrangement similar to that of FIG. 4, but employing separate spring-loaded shoes cooperable with a common drive roller for introducing the separate fiber slivers to the combing cylinder.

FIG. 7 illustrates a sliver-feeding arrangement in which the pressure element cooperating with the common drive roller 14 includes a pair of spring-loaded shoes 15—15. The arrangement of FIG. 7 is interchangeable with that of FIG. 5 in the overall schemes of FIGS. 3 and 4.

Figure 8:
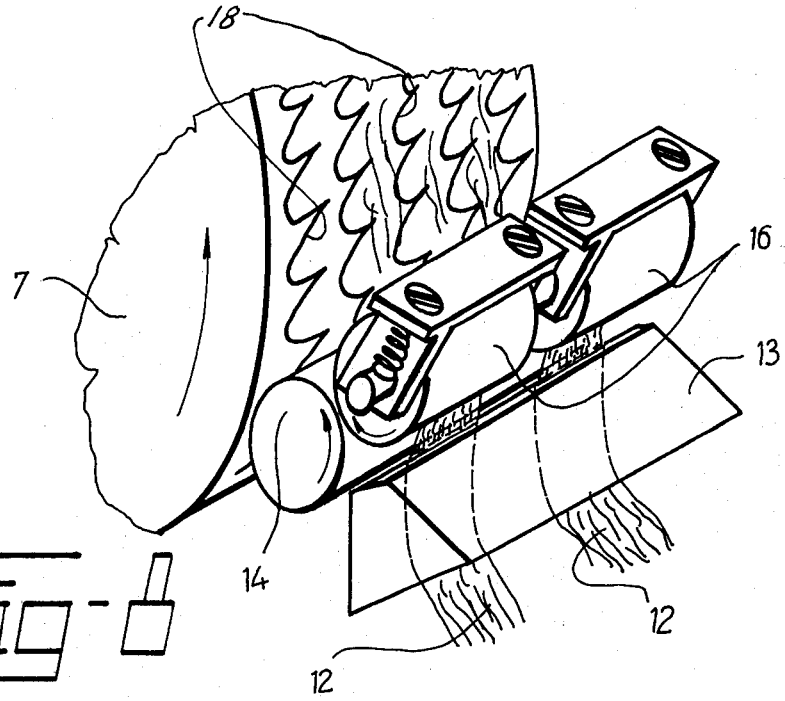
FIG. 8 is a perspective fragmentary view showing an alternative configuration of the spring-loaded pressure means cooperable with the common drive roller of FIG. 7.

In the alternative arrangement of FIG. 8, the pressure element bearing against the common drive roller 14 may include a pair of spaced rollers 16—16, which are individually associated with the slivers 12—12 shaped and compressed by the condenser 13 as indicated above.

Figure 9:
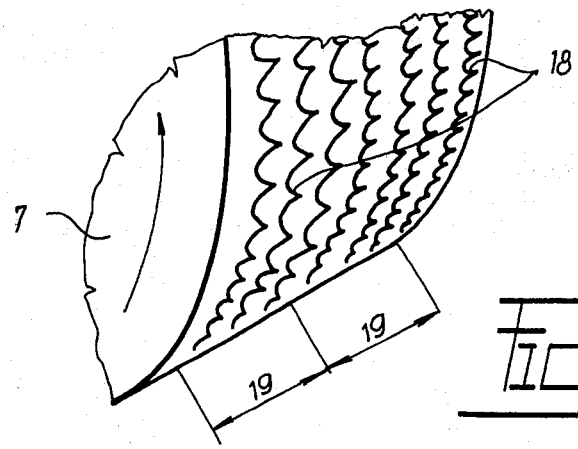
FIG. 9 is a perspective fragmentary view of the periphery of a combing cylinder suitable for use in any of the embodiments of the invention, such periphery exhibiting combing elements that vary in the axial direction.

FIG. 9 shows a suitable arrangement of the combing projections on the periphery of the combing cylinder 7. As indicated, a pair of axially spaced combing regions 19—19 are disposed across the cylinder 7 to accommodate the two separate slivers 12—12 incident on the apparatus. The regions 19 accommodate different types of combing teeth or projections 18—18, such teeth being individually chosen to optimally comb the particular type of sliver introduced into the associated region 19.

Figure 10:
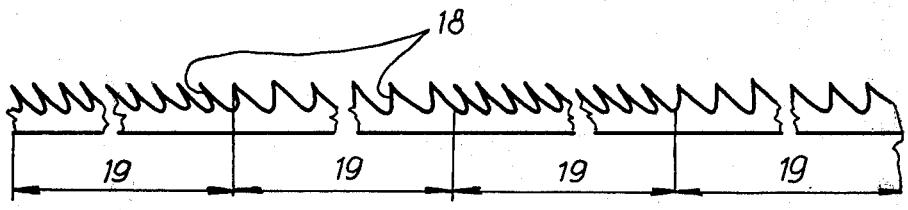
FIG. 10 is a pictorial representation of saw-type combing elements suitable for use on the periphery of the combing cylinder of FIG. 9, the saw-tooth configuration of the combing elements varying in the axial direction.

In the arrangement of FIG. 10, four separate types of slivers may be simultaneously introduced to the periphery of the combing cylinder 7, as represented by four axially adjacent combing regions 19. As shown, each of the regions 19 include saw-type projections 18—18, whose configurations are individual to the separate combing regions 19. The particular shapes of the saw-like projections 18 are chosen to optimize the combing characteristic for the particular fiber sliver introduced to the associated region 19.

In the foregoing, the invention has been described in connection with several embodiments thereof. Many variations and modifications will now occur to those skilled in the art. It is accordingly desired that the scope of the appended claims not be limited to the specific disclosure herein contained.

What is claimed is:

1. In an open-end yarn spinning system, a housing comprising at least one internal bore having an axis parallel to a first axis and a common elongated stationary duct extending through the housing and intersecting each of the internal bores upstream of a first end of the duct, the regions of intersection of the duct and each bore defining a fiber-stripping zone, a combing cylinder mounted coaxially in each internal bore, the annular spaces between the periphery of each combing cylinder and the surrounding wall of the associated bore defining a fiber-separating zone whereby fiber slivers introduced into the separating zone are separated by action of the combing cylinder and separated fibers are discharged via the stripping zone into the duct to flow as a common interengaging fiber flow directly downstream in the duct toward the first end of the duct without substantial further separation when the associated combing cylinder is rotated and to effect the joining of flows of separated fibers from the first and second slivers into a common interengaging downstream flow in the portion of the duct between the fiber-stripping zone and the first end of the duct, yarn spinning means disposed at the first end of the duct for receiving said interengaging fiber flow of separated fibers discharged into the duct and flowing toward the first end, the spinning means being mounted for rotation about a second axis which is skewed relative to said first axis, and means for introducing first and second fiber slivers into spaced portions of the fiber-separating zone.

2. A system as defined in claim 1, in which two spaced internal bores are provided in the housing, the bores intersecting the ducts at axially spaced portions thereof, in which first and second ones of the combing cylinders are separately mounted for rotation in the respective bores to define first and second fiber-separating zone portions, and in which the introducing means comprises, in combination, means for applying the first fiber sliver to the first separating zone portion and for applying the second fiber sliver to the second separating zone portion.

3. A system as defined in claim 1, in which a single bore is provided in the housing, in which a single combing cylinder is disposed in the bore to define the fiber-separating zone, and in which the introducing means comprises means for individually applying the first and second fiber slivers to the fiber-separating zone at spaced portions thereof.

4. A system as defined in claim 3, in which the introducing means comprises, in combination, a fiber condenser for shaping fiber slivers applied thereto, at least one drive roller disposed for rotation adjacent an inlet portion of the fiber-separating zone, and pressure means resiliently urged against the drive roller to define therebetween a nip for drivingly receiving shaped fiber slivers from the fiber condenser.

5. A system as defined in claim 4, in which the introducing means includes separate first and second drive roller individually having axes parallel to the first axis.

6. A system as defined in claim 5, in which the first and second drive rollers are coaxial and are disposed in axially adjacent relation.

7. A system as defined in claim 5, in which the first and second drive rollers are disposed adjacent circumferentially spaced portions of the fiber-separating zone.

8. A system as defined in claim 4, in which the introducing means has a common drive roller.

9. A system as defined in claim 8, in which the pressure means comprises a spring-loaded shoe bearing against the common drive roller, the shoe having axially spaced cutouts for receiving the first and second fiber slivers.

10. A system as defined in claim 8, in which the pressure means comprises first and second spring-loaded shoes separately bearing against axially spaced portions of the common drive roller.

11. A system as defined in claim 4, in which each drive roller is fluted by means of circumferentially spaced axial corrugations.

12. A system as defined in claim 11, in which first and second ones of the drive rollers are disposed in coaxial relation, and in which the corrugations on the first drive roller are circumferentially offset with respect to the corrugations on the second drive roller.

13. A system as defined in claim 1, in which the peripheral combing surface of each combing cylinder has adjacent axially spaced portions provided with mutually distinct types of combing elements.

14. A system as defined in claim 13, in which the combing elements are saw-like projections.

15. In an open-end spinning technique wherein fiber slivers are introduced into an arcuate separating zone disposed between a rotatable combing cylinder and a surrounding bore in a housing to be separated by the action of the combing cylinder, the separated fibers being discharged into a duct which intersects the bore in the housing to form a fiber-stripping zone, the steps wherein the discharged separated fibers flow through a common duct into a yarn spinning device rotatably mounted at the downstream end of the duct; wherein the axis of rotation of the yarn spinning device is oriented in skewed relation to the axis of the bore; and wherein at least first and second separate fiber slivers are introduced at spaced portions of the separating zone so that the discharged separated fibers from the separate first and second fiber slivers are joined in a common flow in the region of the duct between the fiber-stripping zone and the downstream end of the duct.

* * * * *